US005910058A

United States Patent [19]

Zheng

[11] Patent Number: 5,910,058

[45] Date of Patent: Jun. 8, 1999

[54] PORTABLE PLAY STRUCTURES

[75] Inventor: Yu Zheng, Covina, Calif.

[73] Assignee: Patent Category Corp., Monrovia, Calif.

[21] Appl. No.: 09/042,852

[22] Filed: Mar. 17, 1998

[51] Int. Cl.[6] ..... A63B 63/08

[52] U.S. Cl. ..... 473/481; 473/487

[58] Field of Search ..... 473/481, 485, 473/487, 488, 480, FOR 100; 273/398, 401, 402

[56] References Cited

U.S. PATENT DOCUMENTS

| | | | |
|---|---|---|---|
| 2,517,463 | 8/1950 | Cobb | 473/481 |
| 3,752,477 | 8/1973 | Hoyt | 473/488 |
| 5,064,195 | 11/1991 | McMahan et al. | 473/480 |

FOREIGN PATENT DOCUMENTS

| | | | |
|---|---|---|---|
| 1313021 | 11/1962 | France | 473/100 |

*Primary Examiner*—William H. Grieb
*Attorney, Agent, or Firm*—Raymond Sun

[57] ABSTRACT

Portable play structures are provided that provide fun and entertainment of both adults and children. These structures can be easily and quickly folded and collapsed into a compact configuration. The structure has a backboard having a first loop and a second loop, and a basket having a rim that is hingedly coupled to the backboard. In an operative state, the rim is substantially normal to the backboard. In a compact configuration, the rim is substantially parallel to the backboard. The structure has a weight for anchoring the structure to a support, and a connecting piece for hingedly coupling the weight to the backboard.

13 Claims, 3 Drawing Sheets

PORTABLE PLAY STRUCTURES

BACKGROUND OF THE INVENTION

1. Field of the Invention

The present invention relates to portable structures, and in particular, to portable play or game structures which may be conveniently set up for use in a variety of different locations. The portable play structures may be folded or collapsed to reduce the overall profile of the structures to facilitate convenient storage and use.

2. Description of the Prior Art

An important consideration for all toys or play things targeted for children and adults is convenience. Relating to convenience, a toy must be easily transportable so that the user can move it around the home, or even to other places outside of the home. A toy must also be easily stored since an adult or child is likely to have many other toys or objects that compete for precious storage space in the home or in the car.

Larger toys often pose a greater problem with regards to convenience. The larger toys tend to be bulky, which makes it difficult to move them around the home, and sometimes makes it prohibitive to move them outside the house to other locations. Bulky toys also take up much storage space. For these reasons, many executive toys targeted for adults are made in small sizes.

Although there are executive toys that are related to a basketball game, these toys suffer from several disadvantages. First, many of these basketball toys require rigid portions (e.g., mounting brackets or hooks) for installation and set-up. For example, a currently-available basketball game structure provides a relatively rigid backboard with a rigid hook-shaped support that is adapted to hang from the top edge of a door. These rigid portions are not foldable or collapsible, thereby making the toy bulky and ill-suited for storage and transportation. In addition, the rigid nature of these rigid portions renders these toys inflexible for use in a variety of locations, since these rigid portions have a fixed shape and size that limit the objects or structures that they can be supported from.

Further, screws, bolts or nails are often needed to fixably couple the toy to a support structure, such as a wall. When the toy is detached from the support structure, holes and other damage to the support structure (e.g., wall) remain leaving an unsightly support structure. Moreover, because the toy is fixably coupled and not easily moved without substantial effort and damage to the support structure, the toy cannot flexibly adapt to the heights of different players. For example, in a home, a first basketball toy might be installed at a first height for the parents and adults, and a second basketball toy might be installed at a second height that is suited for the children. Two of these toys are needed because the player would rather pay the extra money to purchase a second toy than incur the cost and inconvenience of moving one toy between two different heights.

The requirement of bulky, rigid portions and screws indicate that these conventional executive toys are designed to be permanently installed in the office or home. In the design of these conventional toys, minimal thought, if any, appear to have been given to simplifying the process and time needed to remove the toy and to move the toy to a different venue. As noted earlier, if one desires to play with the basketball toy at a different venue or at a different location in the same venue, one must either purchase an additional toy for the new venue, or incur substantial effort and inconvenience in dismantling the toy from the current venue and in installing the toy in the new venue. Dismantling the toy often damages the walls and leaves unsightly holes in the support structure to which the toy was attached. Installing the toy requires tools and often invasively affects and alters the support structure. Of course, this entire burdensome procedure must be repeated to return the toy to the first venue.

Furthermore, not only is there substantial effort involved, but in certain instances and venues, it is not feasible or desirable to permanently install such toys with the attendant intrusion of the premises (e.g., drilling holes in the walls etc.). A guest's home, a hotel, a public place or any place where one is not free to affect the wall and premises, are all examples of venues in which it may not be feasible or possible to install these toys. Accordingly, these conventional toys suffer from the disadvantages of being inconvenient to install and remove, and not being easily stored or moved around.

The conventional basketball game described above has additional shortcomings. First, as in the example described above, these basketball toys depend on the engagement of a door frame and a closed door to hold the basketball hoop in place. When the door is open, the basketball hoop is not secured and cannot be used to play basketball. Thus, these toys can only be placed in limited locations in a home or office (i.e., these toys can be located only behind closed doors). Depending on the location of the door with respect to a wall and the room, the placement may not be ideal for play. For example, a door which is located near a corner may not be as accessible as a door which is located near the center of a wall away from corners of a room. Moreover, since the door frame is normally located at an adult's height, these toys may not be suitable for children who require a basket at their own height. These factors limit the overall usefulness of such toys.

Consequently, there remains a need for a basketball game toy that features a compact profile when collapsed, that is easily installed without tools and removed without damage to the support structure, that is easily transported between venues and between different locations in a particular venue, and that overcomes the disadvantages of existing basketball game structures discussed previously.

SUMMARY OF THE DISCLOSURE

The present invention provides portable game structures or toys that provide fun and entertainment for both adults and children. These play structures can be easily and quickly folded or collapsed into a compact configuration. As a result, the play structures according to the present invention are convenient to use, to move around, and to store, thereby making them ideal for use at home, at the office as an executive toy, and at many other locations.

It is a further object of the present invention to provide a play structure that can be detached from a support structure without damaging or invasively affecting or modifying the support structure.

It is yet another object of the present invention to provide a play structure that can be adjusted in height to flexibly adapt to players of different heights.

It is yet another object of the present invention to provide a play structure that does not require rigid portions, such as mounting brackets and hooks, and further does not require screws, bolts and nails to secure the toy to a support structure.

It is a further object of the present invention to provide a play structure that is easily transported between venues and between different locations in a particular venue.

It is a further object of the present invention to provide a play structure that is easily installed and set up without substantial effort and without the need for tools.

It is yet another object of the present invention to provide a play structure that does not require a closed door to provide a suitable support structure.

In order to accomplish the objects of the present invention, portable play structures are provided that provide fun and entertainment of both adults and children. These play structures can be easily and quickly folded or collapsed into a compact configuration. The play structure according to the present invention has a backboard having a first loop and a second loop, and a basket having a rim that is hingedly coupled to the backboard. In an operative state, the rim is substantially normal to the backboard. In its compact configuration, the rim is substantially parallel to the backboard. A first support member and a second member, each having a first end and a second end, are provided for coupling the rim to the backboard. The play structure further includes a weight for anchoring the play structure to a support structure, and a connecting piece for hingedly coupling the weight to the backboard.

According to one embodiment of the present invention, the connecting piece extends as a single piece from the backboard to the weight.

According to another embodiment of the present invention, the connecting piece extends as a plurality of pieces from the backboard to support one or a plurality of weights.

According to another embodiment of the present invention, the connecting piece can be a separate piece that is integrally connected to the backboard along a connecting line.

According to another embodiment of the present invention, the connecting piece includes one or more strings or ropes that can be detachably attached to the backboard.

According to yet another embodiment of the present invention, the play structure has one or more suction cups that are attached to a rear surface of the backboard.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
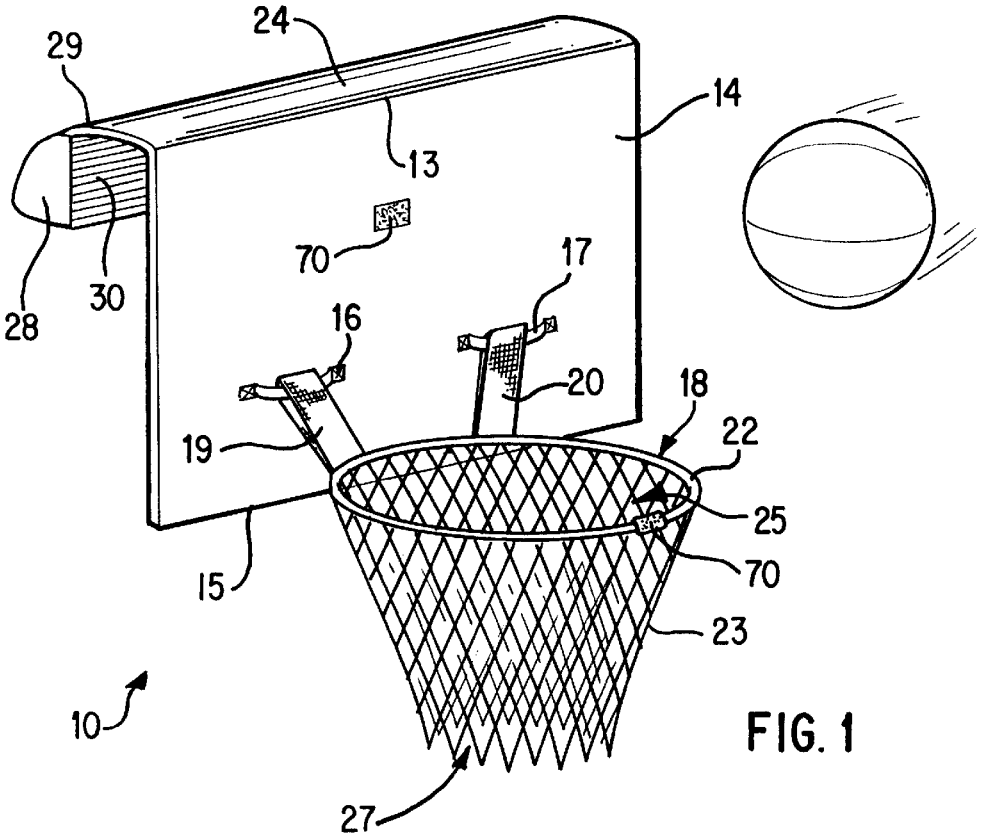
FIG. 1 is a perspective view of a portable play structure according to a first embodiment of the present invention shown in an operative state.

FIG. 1 illustrates a play structure 10 according to the present invention in its operative position. The structure 10 includes a backboard 14, a basket 18, a connecting piece 24, and a weight 28.

The backboard 14 is preferably made from a material that provides a relatively flat, panel-like surface when the structure 10 is supported from a supporting structure, and can be made from either a hard or soft material. For example, a hard material, such as cardboard or plastic, can be employed. A soft material, such as foam, a thick durable cloth, a meshed material or panel, can also be employed. The backboard 14 provides a relatively flat surface on which a toy ball can bounce thereby allowing a player to "bank" the toy ball off the backboard 14 into the basket 18. The backboard 14 includes a first loop 16 and a second loop 17 that facilitate the support of the basket 18 as will be described in greater detail hereinafter. Each loop 16, 17 can be formed by stitching or otherwise connecting opposite ends 92, 94 of a strip of material to the backboard 14, as shown in greater detail in FIG. 4.

The basket 18 includes a rim 22 and a net 23. The rim 22 can be a metal, plastic or other substantially rigid loop. The rim 22 is hingedly coupled to the backboard 14. In a preferred embodiment, the rim 22 is sewn or otherwise non-detachably coupled to the backboard 14 in such a way as to allow the rim 22 to pivot about an axis formed at the junction of the rim 22 and the backboard 14. Accordingly, the rim 22 can be folded into a collapsed state (also referred to herein as a compact configuration) as will be described in greater detail hereinafter with reference to FIG. 3. According to another embodiment, the basket 18 is not attached to the backboard 14, but instead is supported from the backboard 14 by the support members 19, 20 described below.

The net 23 can be made from a meshed material or a fabric. The net 23 includes a first or top opening 25 for receiving a basketball and a second or bottom opening 27 for releasing the basketball. The first opening 25 and the second opening 27 each have a diameter. In a preferred embodiment, the net 23 is funnel-shaped, such that the diameter of the first opening 25 is greater than the diameter of the second opening 27.

Figure 4:
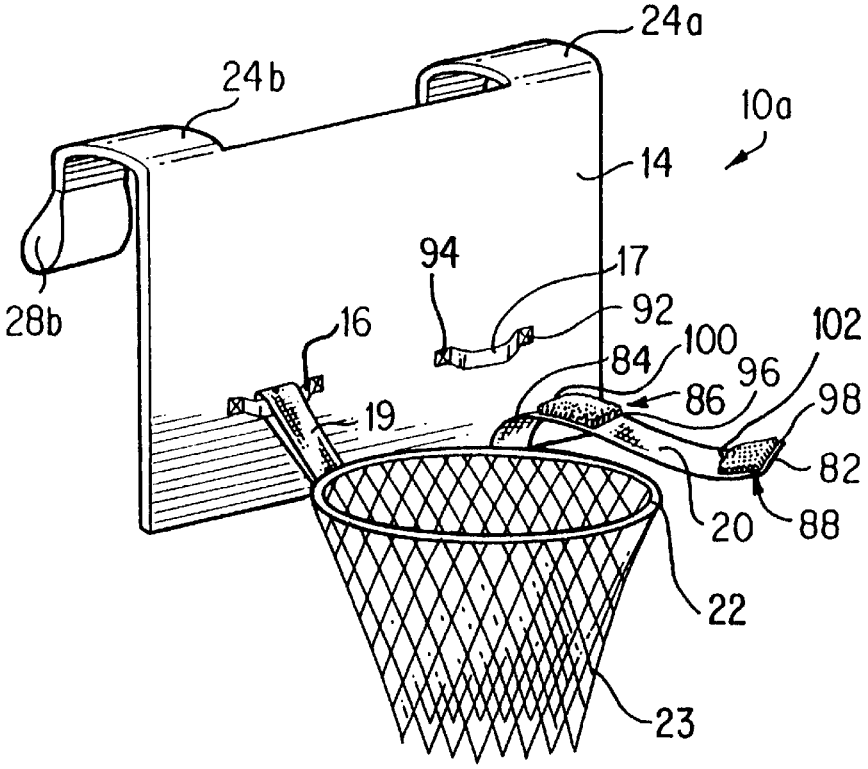
FIG. 4 is perspective view of a second embodiment of a portable play structure of the present invention.

A first support member 19 and a second support member 20 are provided to support the basket 18 from the backboard 14. In a preferred embodiment, each support member 19, 20 may be provided in the form of a loop that includes a first end 84 and a second end 82 (see FIG. 4). The first end 84 of the support member 19 is attached to a location on the circumference of the rim 22, and the first end 84 of the support member 20 is attached to another spaced-apart location on the circumference of the rim 22. The second end 82 of the support member 19 and the second end 82 of the support member 20 can be inserted through the first loop 16 and the second loop 17, respectively, and doubled back to be attached, either to the rim 22 at the first ends 84, or to the support members 19, 20 along the length of the support members 19, 20. The attachment of the first and second ends 84, 82 of the support members 19, 20 may be accomplished by conventional attachment techniques, such as by stitching, or by using hooks or opposing VELCRO™ pads, among others. One example is illustrated in FIG. 4, in which opposing VELCRO™ pads 86, 88 are provided adjacent the first and second ends, 84, 82, respectively, to connect and complete the looped support members 19, 20.

In a preferred embodiment, the first and second support members 19, 20 are sized and configured to cooperate with the first and second loops 16, 17 to support the rim 22 in a manner that maintains the rim 22 at approximately a 90 degree orientation with respect to the backboard 14 (i.e., the rim 22 is approximately normal to the backboard 14). For example, this can be accomplished by controlling the location of the loops 16, 17 and the size of the looped support members 19, 20. In this regard, the support members 19, 20 provide adjustability to the orientation and position of the rim 22 and the basket 18 with respect to the backboard 14. This can be accomplished by varying the size of the loop of the support members 19, 20. For example, the size of the loop of the support members 19, 20 can be decreased to pull the rim 22 higher, or increased to allow the rim 22 to sag further away from the backboard 14. The length of the opposing VELCRO™ pads 86, 88 facilitate the adjustment of the size of the loop of the support members 19, 20 because the user can attach, for example, the upper ends 96, 98, of the VELCRO™ pads 86, 88, respectively, together, or the lower ends 100, 102, of the VELCRO™ pads 86, 88, respectively, together, to provide a larger loop size. To provide a smaller loop size, the entire length of the VELCRO™ pad 86 can be attached to the entire length of the VELCRO™ pad 88. To further facilitate the positioning of the rim 22 with respect to the backboard 14, the loops 16, 17 can be positioned at a vertical level that is sufficiently above the bottom edge 15 of the backboard 14, and the loop size of the support members 19, 20 adjusted in the manner described above, to allow the rim 22 to contact and pivot against the backboard 14 as shown in FIG. 1. As described above, the rim 22 can be attached to the backboard 14 at this pivot point, or such an attachment can be omitted so that the rim 22 is only supported by the support members 19, 20.

Figure 2:
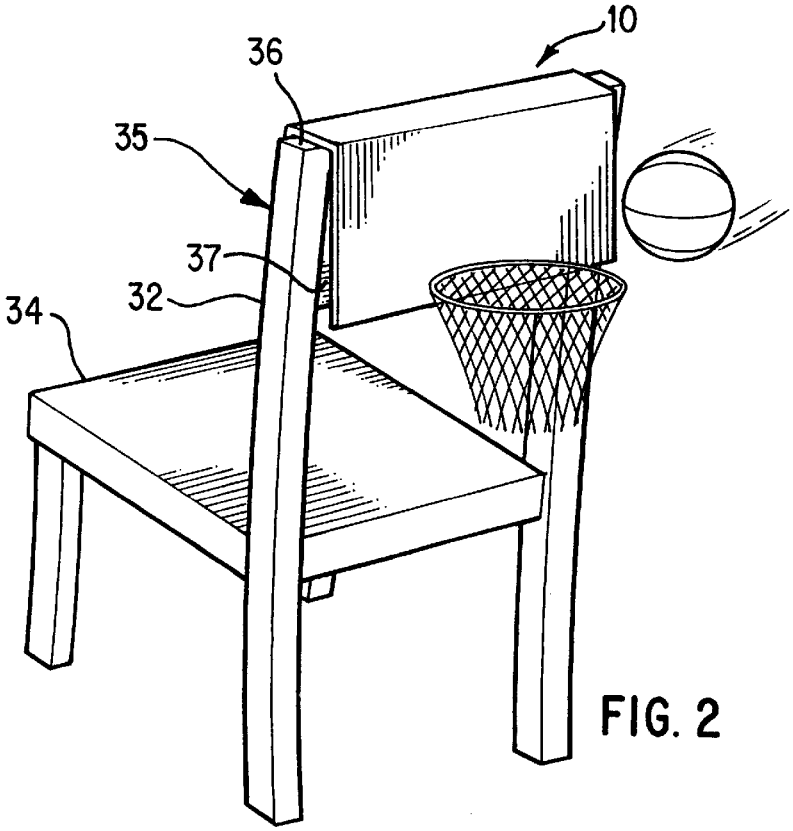
FIG. 2 is perspective view of the structure of FIG. 1 removably supported at the back of a chair.
Figure 3:
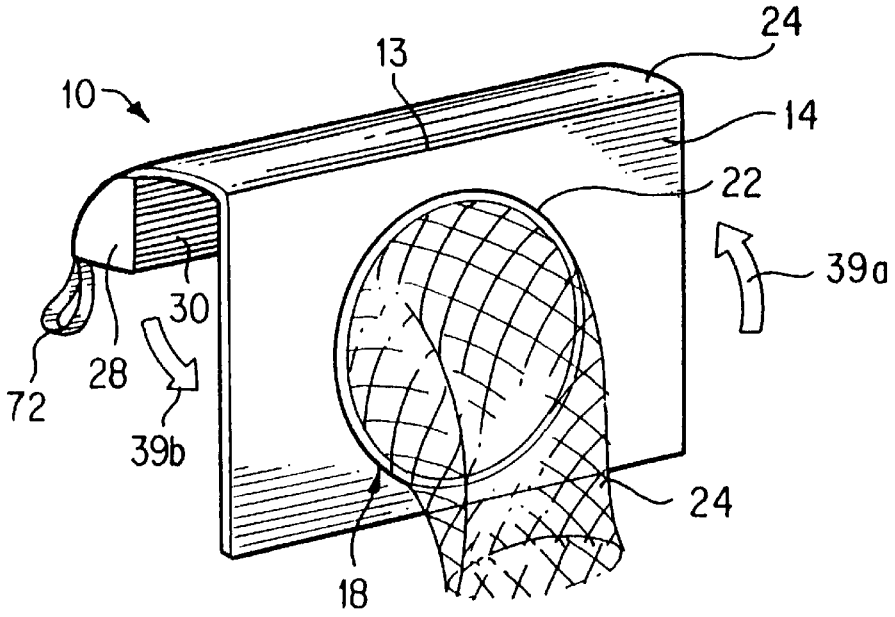
FIG. 3 is a perspective view of the structure of FIG. 1 in a folded or collapsed state.

The connecting piece 24 can be a soft and flexible meshed material or a cloth piece that connects the backboard 14 with a weight 28. In a preferred embodiment as shown in FIGS. 1–3, the connecting piece 24 extends as a single piece from the backboard 14 to the weight 28. A hinge line 13 is defined for folding the structure 10, as described in greater detail below. As an alternative, the connecting piece 24 can be a separate piece that is integrally connected to the backboard 14 along a connecting line 13 (which also operates as a hinge line) by stitching, for example. The connecting piece 24 can be made from the same material as the backboard 14. The connecting piece 24 can also be provided with a width that is smaller, the same as, or larger than the width of the backboard 14. As another example, as illustrated hereinafter with reference to FIG. 5, the connecting piece 24 can be replaced by detachable strings or ropes 38.

The weight 28 is provided to anchor the play structure 10 over a support structure. The support structure can be the back of a chair, as illustrated in FIG. 2, or any other similar support structure, such as but not limited to the back of a door, a table top, the top of a file cabinet, a book shelf, among others. In a preferred embodiment illustrated in FIGS. 1–3, a single weight 28 is provided and stitched across the width of the backboard 14 along stitch line 29. This weight 28 can be an elongated sandbag (i.e., sand retained inside a bag or pouch) that is stitched to the connecting piece 24, or an elongated metal piece, a plastic piece or any weighted object retained in a sleeve that is stitched to the connecting piece 24. In alternative embodiments, one or more weights of different shapes and sizes can be employed and attached in spaced-apart manner to the connecting piece 24, with or without a bag or sleeve. As long as the cumulative weight of the weights 28 is sufficient to counter balance the backboard 14 and the basket 18, any configuration or number of weights can be employed.

The weight 28 further includes a support structure engaging surface 30. In the preferred embodiment, the support structure engaging surface 30 includes a plurality of micro-bumps or strips for increasing the frictional resistance between the support structure and the support structure engaging surface 30. These micro-bumps and strips can also be employed on the surface of the connecting piece 24 and the backboard 14 that engage the support structure.

FIG. 2 is perspective view of the play structure 10 of FIG. 1 removably supported in its operative state by a seat back 32 of a chair 34. The seat back 32 includes a first surface 35 for contacting the back of a person seated in the chair, a ridge or top edge 36, and a second surface 37. As illustrated in FIG. 2, the seat back 32 of the chair 34 provides a support structure in the form of the ridge 36 over which the structure 10 of the present invention can be draped. When so deployed, the connecting piece 24 rests against the ridge 36, with the weight 28 contacting the first surface 35 of the seat back 32, and the backboard 14 either contacting the second surface 37 of the seat back 32, or suspended from the ridge 36 (depending on the angle of the seat back 32). In addition, a tie member or loop 72 (see FIG. 3) can be provided at the weight 28 for attaching or otherwise coupling the weight 28 to the support structure.

It can be seen that the structure 10 can also be easily deployed in the same manner over the top edge of an open door, for example. As an additional example, the structure 10 can be deployed on a shelf of a bookshelf, or a table top, for example, by placing the weight 28 and the connecting piece 24 on the shelf or table top, and suspending the backboard 14 along the hinge line 13 from the edge of the shelf or edge of the table.

FIG. 3 is a perspective view of the play structure 10 of FIG. 1 in a collapsed state, which is also referred to herein as a compact configuration. To collapse the structure 10 to the compact configuration, the rim 22 is pivoted upwardly against the backboard 14 in the direction of arrow 39*a*, and the connecting piece 24 folded against the back of the backboard 14, about the hinge line 13, in the direction of arrow 39*b*. In the compact configuration, the rim 22 is substantially parallel to (or held against) the front of the backboard 14 and the connecting piece 24 and weight 28 are parallel (or held against) the back of the backboard 14. A detachable connecting mechanism, such as a hook or opposing VELCRO™ pads 70 (see FIG. 1), can be provided to secure the rim 22 against the backboard 14 in the compact configuration. As can be seen in FIG. 3, the structure 10 can easily and quickly be transformed from the compact configuration to the operative state and vice-versa. It is also evident from FIG. 3 that the compact configuration of the structure 10 provides a compact and slim profile that can readily be stored in a narrow and compact space thereby increasing the ease and convenience of storage and transportation.

FIG. 4 is a perspective view of an alternative embodiment of the play structure 10*a* of the present invention. The structure 10*a* is essentially the same as the structure 10 of FIGS. 1–3, except that instead of a single, integral connecting piece 24 as illustrated in FIG. 1, the structure 10*a* includes two separate connecting pieces 24*a*, 24*b* provided at opposite sides of the backboard 14, with each connecting piece 24*a*, 24*b* having a first end that is integrally attached to a separate weight 28*a* (not shown) and 28*b*, respectively. The second opposing end of each connecting piece 24*a*, 24*b* can be attached to the backboard 14 in the same manner as the connecting piece 24 is attached to the backboard 14. For example, the connecting pieces 24*a*, 24*b* can be provided as one piece with the backboard 14, or can be provided as separate pieces and stitched together.

Figure 5:
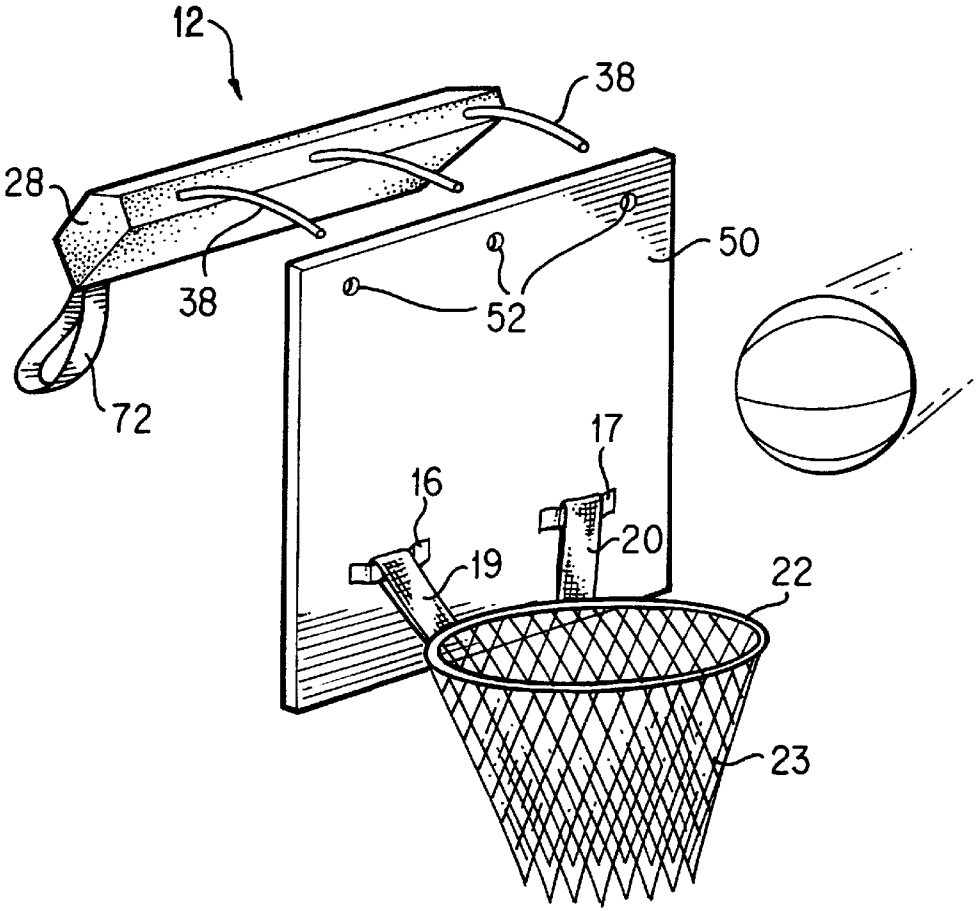
FIG. 5 is a perspective view of a third embodiment of a portable basketball structure of the present invention.

FIG. 5 is a perspective view of an alternative embodiment of the play structure 12 of the present invention. Instead of a single, integral connecting piece 24 as illustrated in FIG. 1 the structure 12 includes one or more connecting pieces that can take the form of strings or ropes 38 each having a first end that is integrally attached to the weight 28. These strings or ropes 38 each have a second end that can be detachably coupled to the backboard 50. The backboard 50 defines a plurality of holes 52, with each hole 52 corresponding to one of the strings 38. One can thread the second end of each string 38 through a corresponding hole 52 and tie the string 38 to the backboard 50. Any number of these strings 38 can be provided and used to connect the weight 28 with the backboard 50. In this manner, the weight 28 can be selectively detached from or coupled to the backboard 50. When the weight 28 is detached from the backboard 50, the holes 52 can be employed to hang the structure 12 on a support structure, such as a wall. For example, one can insert nails through the holes to hang the structure 12 on a wall, even though may not be desirable because it will create unsightly holes in the wall. Nevertheless, this illustrates the flexible nature of the structures 10, 10*a*, 12 according to the present invention, and their wide applicability in use in many different locations.

For the sake of brevity, the other remaining components of the structures 10*a* and 12 that are similar to those components described previously in FIG. 1 for structure 10 will not be described herein, with these components bearing the same numeral designations as those components illustrated in FIG. 1. The structures 10*a* and 12 can be collapsed in the same manner as the structure 10, except that the connecting pieces 24*a*, 24*b*, and the strings 38, now operate as hinge lines about which the connecting pieces 24*a*, 24*b*, the strings 38 and the weights 28, 28*a*, 28*b* can be pivoted.

Figure 6:
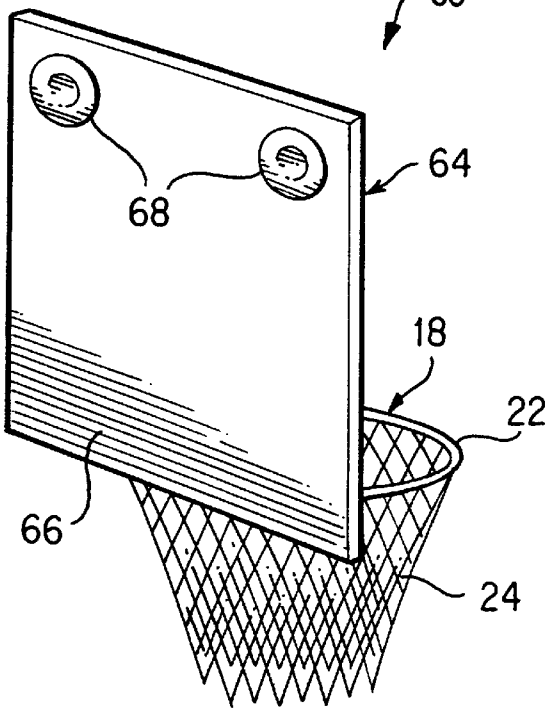
FIG. 6 is perspective view of a fourth embodiment of a portable play structure of the present invention.

FIG. 6 is a perspective view of yet another embodiment of the play structure 60 of the present invention. In this embodiment, the backboard 64 includes a rear surface 66 and one or more suction cups 68, attached to the rear surface 66. The suction cups 68 are employed to detachably couple the backboard 64, and the structure 60, to a supporting surface (e.g., the surface of a wall, door, seat back etc.). Since the suction cups 68 allow the structure 60 to couple to a supporting surface, a connecting piece and a weight are not needed in this embodiment. The structure 60 can be collapsed to its compact configuration merely by folding the rim 22 upwardly in the direction of arrow 39*a*, as shown in FIG. 3. Since there is no connecting piece or weight, nothing else needs to be folded. Again, for the sake of brevity, the other remaining components of the structure 60 that are similar to those components described previously in FIG. 1 will not be described herein, with these components bearing the same numeral designations as those components illustrated in FIG. 1.

To open or deploy any of the structures 10, 10*a*, 12 or 60 of the present invention from their collapsed configurations, the user merely unfolds the rim 22 in the direction opposite to the arrow 39*a*. The weight of the rim 22 will bias the rim 22 into its operative state. The user then detachably supports the structure 10, 10*a*, 12 or 60 to a support structure (e.g., a seat-back, or a book shelf), and the structure 10, 10*a*, 12, 60 is ready for use and play.

Thus, the embodiments of FIGS. 1, 4, 5 and 6 provide improved play structures which provide the player with fun and entertainment. The shapes, sizes, and features of the components (e.g., the backboard, the basket, the weight, connecting piece, support members, and loops) of the improved play structures of the present invention can be varied or combined.

The structures 10, 10*a*, 12, 60 of the present invention are easily and conveniently deployed and collapsed for ease of storage and transportation. The inconvenience of mounting brackets, hooks, screws, nails and bolts is obviated through the use of the weight 28 and the configuration of the basket 18, the backboard 14 and the connecting piece(s) 24, 24*a*, 24*b*, 38. For these reasons, the structures 10, 10*a*, 12, 60 are extremely portable and can be carried around conveniently and enjoyed at many different locations by many different people.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A structure adapted to be supported on a support member, comprising:

a backboard having a weight;

a basket having a weight and including a rim coupled to the backboard, said rim having an operative state wherein the rim is substantially normal to the backboard and a compact configuration wherein the rim is substantially parallel to the backboard; and a weight member hingedly coupled to the backboard and having sufficient weight to counterbalance the weight of the backboard and the basket.

2. The structure of claim 1, wherein the backboard has a first loop and a second loop, the structure further including a first support member and a second support member coupled to the first loop and second loop, respectively, for supporting the basket in the operative state.

3. The structure of claim 2, wherein the first support member has a strap having a first end and an opposing second end, with the first end of the strap coupled to the rim, and the second end is passed through the first loop and secured to the second end of the strap.

4. The structure of claim 1, wherein the basket further includes a net that defines a first opening having a diameter and a second opening having a diameter, wherein the diameter of the first opening is greater than or equal to the diameter of the second opening.

5. The structure of claim 1, further comprising at least one attachment loop coupled to the weight member, said attachment loop for supporting the structure on a support member.

6. The structure of claim 1, further including a connecting piece for hingedly coupling the weight member to the backboard.

7. The structure of claim 6, wherein the connecting piece extends as a single piece from the backboard.

8. The structure of claim 6, wherein the connecting piece extends as a plurality of connecting pieces from the backboard to support the weight member.

9. The structure of claim 8, wherein the weight member comprises a plurality of weight members, each corresponding to one of the plurality of connecting pieces.

10. The structure of claim 6, wherein the connecting piece includes at least one string, said string having a first end coupled to the weight member and a second end detachably coupled to the backboard.

11. A structure adapted to be supported on a support member, comprising:

a backboard having a first loop and a second loop;

a basket including a rim coupled to the backboard, said rim having an operative state wherein the rim is substantially normal to the backboard and a compact configuration wherein the rim is substantially parallel to the backboard;

a first support member and a second support member coupled to the first loop and second loop, respectively, for supporting the basket in the operative state;

a weight; and a connecting piece for hingedly coupling the weight to the backboard.

12. The structure of claim 11, wherein the first support member has a strap having a first end and an opposing second end, with the first end of the strap coupled to the rim, and the second end is passed through the first loop and secured to the second end of the strap.

13. A structure adapted to be supported on a support member, comprising:

a backboard;

a basket including a rim coupled to the backboard, said rim having an operative state wherein the rim is substantially normal to the backboard and a compact configuration wherein the rim is substantially parallel to the backboard;

a weight;

at least one attachment loop coupled to the weight, said attachment loop for supporting the structure on a support member; and a connecting piece for hingedly coupling the weight to the backboard.

* * * * *